US005573468A

United States Patent [19]

Baumann

[11] Patent Number: 5,573,468

[45] Date of Patent: Nov. 12, 1996

[54] GOLF PUTTER

[76] Inventor: Peter Baumann, 1351 Ridge Dr., Yreka, Calif. 96097

[21] Appl. No.: 565,071

[22] Filed: Nov. 30, 1995

[51] Int. Cl.[6] ..... A63B 53/12; A63B 53/02

[52] U.S. Cl. ..... 473/312; 473/313; 473/321; 473/256

[58] Field of Search ..... 473/312, 313, 473/316, 318, 320, 321, 322, 323, 256

[56] References Cited

U.S. PATENT DOCUMENTS 1,631,504 6/1927 Redman ..... 473/313
2,100,307 11/1937 McMinn ..... 473/316
5,267,733 12/1993 Szokola ..... 473/313
5,324,032 6/1994 Minami ..... 473/320

*Primary Examiner*—George J. Marlo

[57] ABSTRACT

A golf putter comprises a putter shaft having two opposite ends including a grip end and a head end, a grip attached to the grip end of the putter shaft, and a putter head attached to the end of the putter shaft. The putter shaft has a substantially uniform outer diameter and a wall thickness which is smaller in a region of the grip and greater in the region of the putter head.

11 Claims, 3 Drawing Sheets

GOLF PUTTER

BACKGROUND OF THE INVENTION

The present invention relates to a golf putter.

Golf putters usually include a putter shaft, a grip on one end of the putter shaft, and a putter head on the other end of the putter shaft. In accordance with one approach, the putter shaft has an outer diameter reducing from the putter grip to the putter head. In accordance with another approach, the putter shaft has an identical diameter over its length. Finally, there are golf putters with inverted putter shafts, in which case the putter shaft has a smaller diameter in the region of the tip and a greater diameter in the region of the putter head. Further modifications of the putter shafts for improving its operational characteristics are advisable.

SUMMARY OF THE INVENTION

Accordingly, it is an object of the present invention to provide a golf putter which is a further improvement of the existing golf putters.

In keeping with these objects and with others which will become apparent hereinafter, one feature of the present invention resides, briefly stated, in a golf putter which has a putter shaft having a substantially identical outer diameter over its length and a wall thickness which is selected so that the wall thickness of the putter shaft in the region of the grip and somewhat below it is smaller, and the wall thickness of the putter shaft in the region of the putter head is greater.

When the putter shaft is designed in accordance with the present invention it has more flex and less weight just below the grip, and more stiffness and more weight near the head. As a result, the flex and weight distribution gives a golfer about 30% more momentum in the region of the putter head relative to the region of the grip during the stroke on longer putts, and 60–65% more momentum in the putter head region relative to the grip region on short putts. Since momentum is what actually keeps the putter head on line to the target, the putter shaft in accordance with the present invention maximizes the momentum in the head region. The combination of less weight and more flex near the hands of the golfer, and more weight near the putter head gives the golfer more feel in the hands and more control of the putter head.

Momentum is defined as a mass times velocity. The more momentum is in a moving object, in this case the putter head, the more difficult it is to deviate the object from its intended path. In golf, there is a term known as "the yips". The yips occurs when the golfer's nerves cause the putter head to jerk off line. This occurs on short putts because of the putter head in a conventional putter shaft is very light and therefore lacks enough momentum when stroked easily due to the short length of the putt. The golfer's nerves cause the hands to shake slightly, and that is all that is necessary to turn the putter head off line, causing the putt to miss. When the putter shaft is designed in accordance with the present invention, there is more mass in the putter head in relation to the grip end. This added mass, combined with more flex near the hands, gives the putter more momentum in the head relative to the grip end. Nervousness or shakiness in the hands on short putts is dampened by the heavier weight near the putter head, due to the thicker walled shaft near the head, and the head is more likely to continue on like to target due to that added momentum.

In accordance with another embodiment of the present invention, added weights can be inserted at the point of the thicker wall in the shaft near the putter head. The added weights can be varied depending on the amount of weight desired by each golfer. Taller, stronger golfers require more weight near the putter head to compensate for their added strength, which when confronted with "the yips" will require the added weight for better control of the putter head during the stroke.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
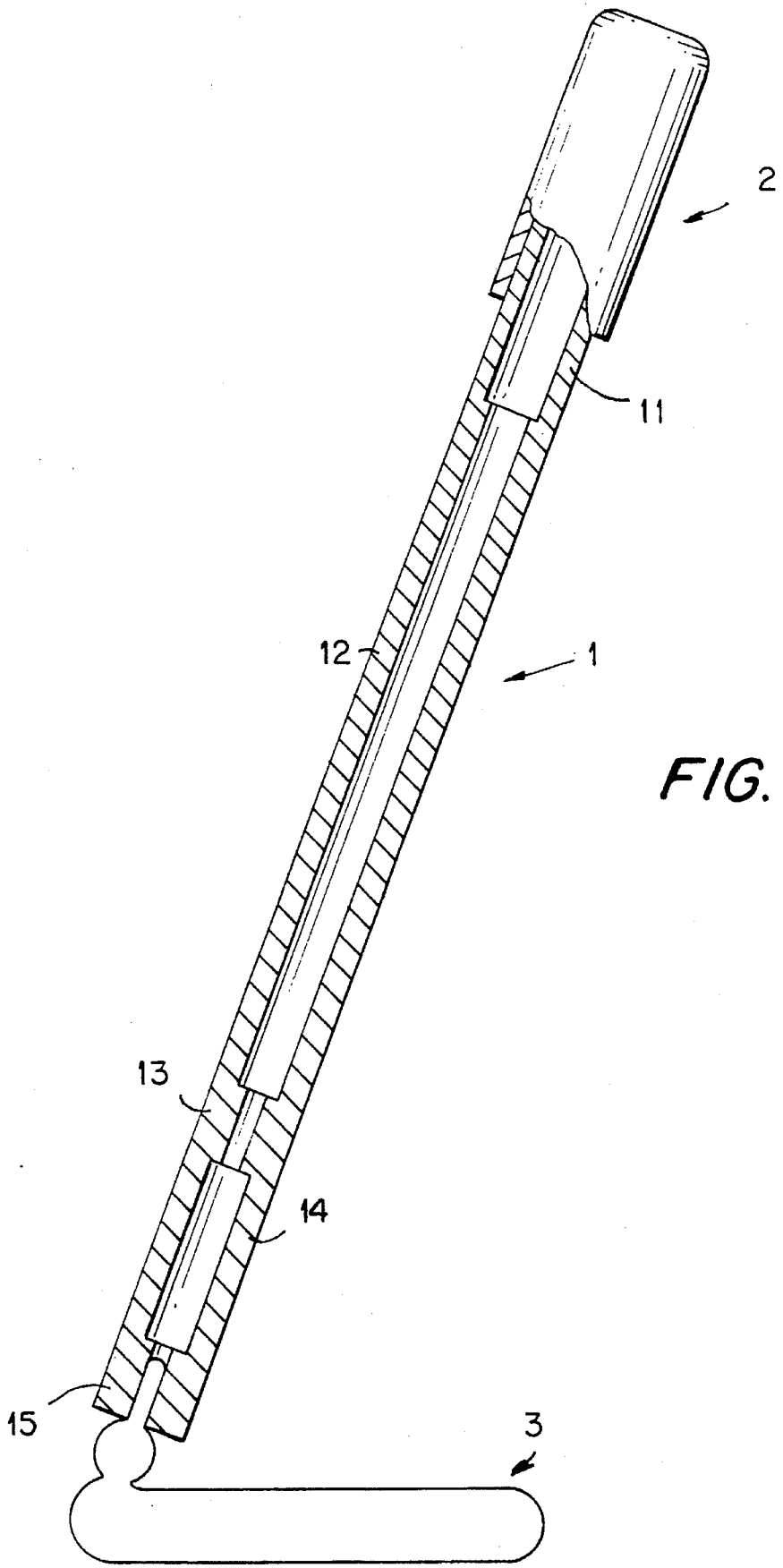
FIG. 1 is a view showing a golf putter in accordance with one embodiment of the present invention.

A golf putter in accordance with the present invention has a putter shaft identified as a whole with reference numeral 1. One end of the putter shaft is provided with a grip 2, while a putter head 3 is arranged on the opposite end of the putter shaft 1.

The putter shaft 1 has a portion 11 extending inside the grip 2 and somewhat below the grip as identified with reference numeral 1. The portion 11 of the shaft 1 has the smallest wall thickness. The putter shaft 1 has a further portion 12 which extends from the portion 11 downwardly toward the putter head and stops approximately within one foot from the lower end of the putter shaft. The portion 12 of the putter shaft has a standard wall thickness which is greater than the wall thickness of the portion 11. The putter shaft 1 has a next portion 13 which extends from the portion 12 over 2–3 inches and has a wall thickness which is greater than the wall thickness of the portion 12. A portion 14 of the putter shaft again has a standard wall thickness corresponding to the wall thickness of the portion 12. The portion 14 can extend over 6–8 inches. Finally, the putter shaft 1 has an end portion 15 which again has a thickness greater than the standard thickness of the portions 12 and 14.

As can be seen from this embodiment, the putter shaft has a mass which is greater in the region of the putter head than in the region of the grip, which provides the advantages specified in detail hereinabove.

Figure 2:
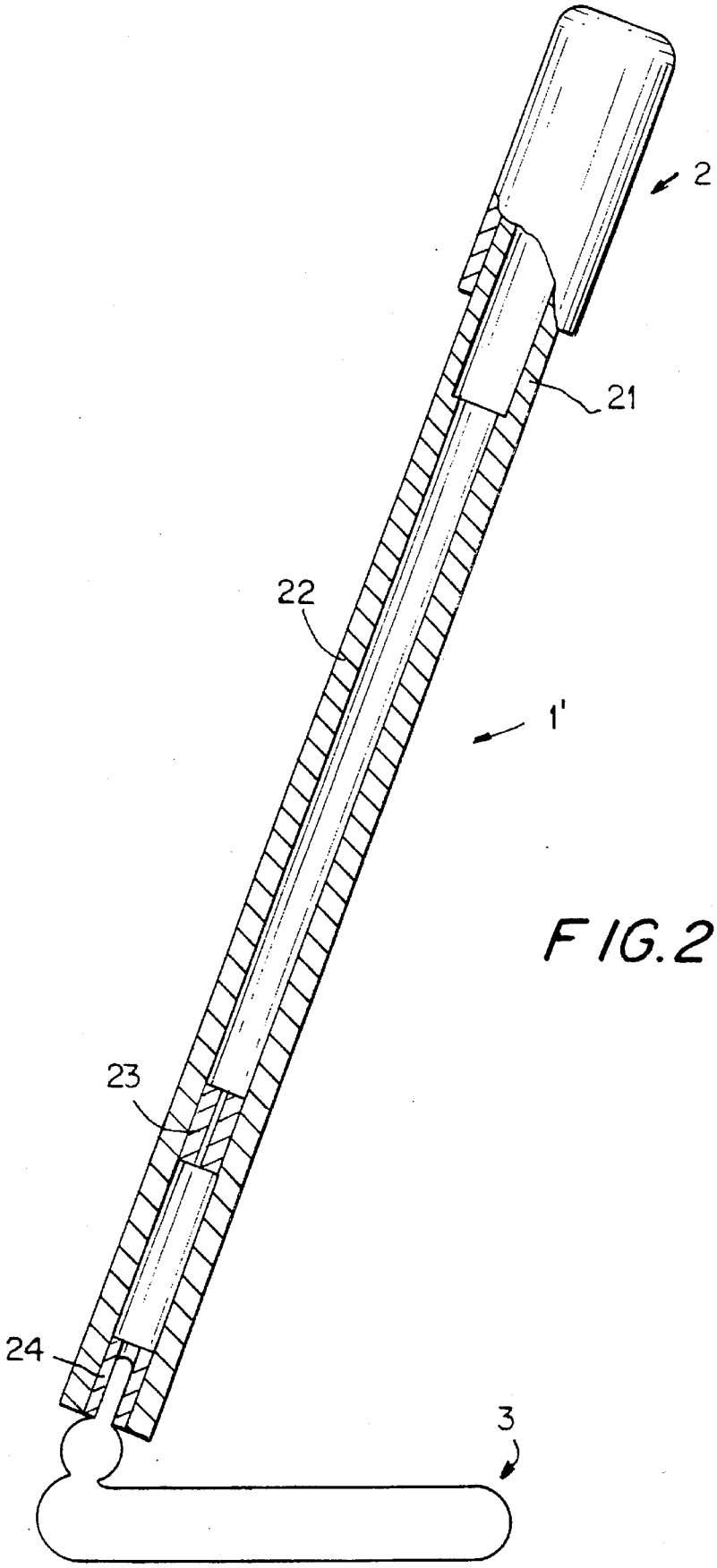
FIG. 2 is a view showing a putter shaft of the inventive golf putter in accordance with another embodiment of the present invention.

In a second embodiment shown in FIG. 2, the golf putter has a putter shaft 1' provided with a grip 2 on its one end and with a putter head 3 on its another end. The putter shaft has a portion 21 extending within the grip 2 and somewhat below it and having the smallest wall thickness. A portion 22 of the putter shaft having a standard wall thickness which is greater than the wall thickness of the portion 21 and extends from the lower end of the portion 21 to the lower end of the putter shaft. Inserts 23 and 24 are inserted in the shaft portion 22 at locations which are spaced from one another in a longitudinal direction. The locations of the inserts 23 and 24 of the putter shaft 1' can correspond to the locations 13 and 15 of the putter shaft 1 of the first embodiment. The inserts 23 and 24 represent additional weights. They can be formed as hollow metal shots shown in the drawings, or as solid inserts, or composed of a heavy substance. The inserts 23 and 24 can be secured in place with the use of an adhesive. The weight of the lower part of the putter shaft therefore can be increased with respect to the weight of the remaining upper portion of the putter shaft 1'. The weight of the lower portion can also be varied by the amount of weight of the inserts 23 and 24, or by insertion of only one of the inserts 23 or 24 instead of both inserts, depending upon the feel desired in the grip and the size and weight of the golfer for whom the shaft is being custom-made.

Figure 3:
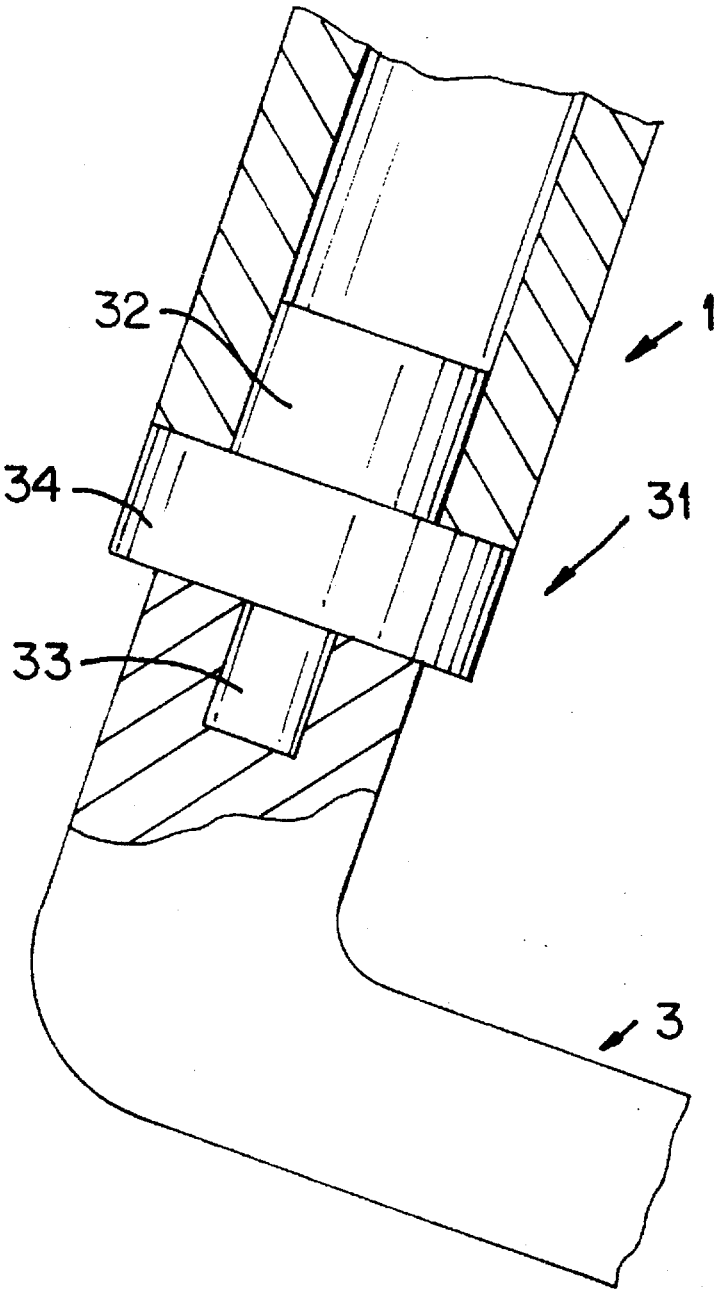
FIG. 3 shows a portion of the inventive golf putter in the region of the putter head, in accordance with still a further embodiment of the present invention.

In the embodiment shown in FIG. 3, the putter shaft in accordance with the present invention is connected to the putter head 3 with interposition of an adaptor 31. The adaptor has a portion 32 of a greater diameter inserted in the lower end of the putter shaft 1, a portion 33 of a smaller diameter inserted into the putter head, and a flange 34 located between the portions 32 and 33. The portions 32 and 33 can be connected with the putter shaft 1 and the putter head 3 for example by adhesive.

Such an adaptor is disclosed in my patent application Ser. No. 491,781.

It will be understood that each of the elements described above, or two or more together, may also find a useful application in other types of constructions differing from the types described above.

While the invention has been illustrated and described as embodied in a golf putter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A golf putter, comprising a putter shaft having two opposite ends including a grip end and a head end; a grip attached to said grip end of said putter shaft; and a putter head attached to said end of said putter shaft, said putter shaft having a substantially uniform outer diameter and a wall thickness which is smaller in a region of said grip and greater in a region of said putter head.

2. A golf putter as defined in claim 1, wherein said putter shaft has a first portion extending inside said grip and somewhat beyond said grip in direction toward said putter head, said first portion being provided with said smaller wall thickness.

3. A golf putter as defined in claim 2, wherein said putter shaft has a second portion extending from said first portion in direction toward said head and being provided with said greater wall thickness.

4. A golf putter as defined in claim 3, wherein said second portion has two sections spaced from one another in a longitudinal direction of said putter shaft and having said greater wall thickness, and a third section located between said two sections and having a smaller wall thickness.

5. A golf putter as defined in claim 4, wherein said putter shaft is a one-piece element including said first portion, said second portion and said sections.

6. A golf putter as defined in claim 4, wherein said putter shaft is provided with two inserts in the regions of said two sections spaced from one another in the longitudinal direction so as to obtain said greater diameter in the region of said two sections.

7. A golf putter as defined in claim 3, wherein said putter shaft is a one-piece element including said first and second portions.

8. A golf putter as defined in claim 1, wherein said putter shaft in the region of said handle is provided with an insert which increases a wall thickness of said putter shaft so as to obtain said greater wall thickness.

9. A golf putter as defined in claim 1; and further comprising means for connecting said putter shaft with said putter head and including an adaptor.

10. A golf putter as defined in claim 9, wherein said adaptor includes a greater diameter first adaptor portion inserted in said putter shaft in the region of said head end and a smaller second adapter portion inserted in a hole provided in said putter head.

11. A golf putter as defined in claim 10, wherein said adaptor has an intermediate flange between said first and second adaptor portions.

* * * * *